US007022189B2

(12) United States Patent
Delle Vedove et al.

(10) Patent No.: US 7,022,189 B2
(45) Date of Patent: Apr. 4, 2006

(54) VACUUM PAINTING HEAD AND RELATIVE PAINTING METHOD

(75) Inventors: Gaetano Delle Vedove, Pordenone (IT); Vittorio Belluz, Charlotte, NC (US)

(73) Assignee: Delle Vedove Levigatrici SpA, Pordenone (IT)

( * ) Notice: Subject to any disclaimer, the term of this patent is extended or adjusted under 35 U.S.C. 154(b) by 14 days.

(21) Appl. No.: 10/503,729

(22) PCT Filed: Jun. 12, 2002

(86) PCT No.: PCT/IB02/02151

§ 371 (c)(1),
(2), (4) Date: Aug. 6, 2004

(87) PCT Pub. No.: WO03/070384

PCT Pub. Date: Aug. 28, 2003

(65) Prior Publication Data

US 2005/0129856 A1 Jun. 16, 2005

(30) Foreign Application Priority Data

Feb. 25, 2002 (IT) ..... UD2002A0045

(51) Int. Cl.
*B05C 11/11* (2006.01)
*B05B 15/04* (2006.01)

(52) U.S. Cl. ..... 118/504; 118/50; 118/326

(58) Field of Classification Search ..... 118/50, 118/504, 326, 309, 404, 405, 720, 733, 125; 425/113

See application file for complete search history.

(56) References Cited

U.S. PATENT DOCUMENTS

| | | | | |
|---|---|---|---|---|
| 2,649,757 | A | 8/1953 | Diamond | |
| 4,653,425 | A * | 3/1987 | Aguettant et al. | 118/326 |
| 6,203,857 | B1 | 3/2001 | Patrick | |

FOREIGN PATENT DOCUMENTS

| | | |
|---|---|---|
| DE | 3615750 | 11/1987 |
| DE | 19707157 | 8/1998 |
| WO | 0185357 | 11/2001 |

* cited by examiner

*Primary Examiner*—Chris Fiorilla
*Assistant Examiner*—Yewebdar Tadesse
(74) *Attorney, Agent, or Firm*—Stevens, Davis, Miller & Mosher, LLP

(57) ABSTRACT

A vacuum painting head to paint objects, including a container having an inlet aperture and an outlet aperture for the object to be painted, wherein the outlet aperture has a transverse section substantially equal to that of the object to be painted, wherein a suction pump is provided to create inside the container a determinate depression with respect to atmospheric pressure, and wherein paint is continuously introduced into the container. A stopper element is inserted into one of the apertures and is selectively movable to move away from or closer to the other aperture to open or close it.

10 Claims, 2 Drawing Sheets

VACUUM PAINTING HEAD AND RELATIVE PAINTING METHOD

This application is a §371 National Stage Application of International Application No. PCT/IB02/02151, filed on 12 Jun. 2002, claiming the priority of Italian Patent Application No. UD 2002 A 000045 filed on 25 Feb. 2002.

FIELD OF THE INVENTION

The present invention concerns a vacuum painting head and the relative method to paint one or more surfaces of any object, whether it be a profile, a panel or otherwise, made of any material, such as wood, metal or plastic material. The painting head comprises a container having, on opposite and aligned sides, an inlet aperture and outlet aperture, through which the object to be painted is able to pass. Inside the container, in a continuous cycle, paint is introduced and air is sucked in; as it enters through the outlet aperture for the profile, the air mixes with the paint, which is thus sucked in towards the outside of the container together with the air. In particular objects, in order to prevent the paint in the container from going to cover the leading and trailing ends of the objects too, a stopper element is inserted into the inlet aperture and is axially movable to move away from and closer to the outlet aperture. Externally, the stopper element has the shape of the inlet aperture and internally it has the shape of the object to be painted.

BACKGROUND OF THE INVENTION

It is known a painting head essentially consisting of a parallelepiped container, with a front wall and a rear wall, parallel to each other, in which an inlet aperture and respectively an outlet aperture are made, both having the shape of the profile to be painted, but bigger than it by few millimetres.

Inside the container a depression is maintained, by means of a suction pump, in the range of 150–250 millibars, and paint is continuously introduced therein by means of a conduit. The term "vacuum" is here intended to mean a depression within that range of values or near such values. Normally the power absorbed by the suction pump is between 7 and 11 KW.

The air outside the container is sucked inside, at very high speed, through the slits existing between the profile which is passing through the container and the afore-mentioned inlet and outlet apertures. In this way, when the profile is inserted into the apertures of the container, the paint introduced therein does not exit from the apertures, because it is sucked in by the suction pump together with the air. The paint is then filtered in an autonomous filter assembly and introduced into the painting head again.

In this conventional painting head, the profiles are usually inserted one after the other, with the leading end of one in contact with the trailing end of the previous one, so as to prevent as much as possible the pressure inside the container from falling, due to a prolonged opening of one or both the inlet and outlet apertures.

This way of working also allows to prevent the leading end and the trailing end of each profile from being painted when this is not desired. In fact, if the following profile enters into the container containing the paint in contact with the trailing end of the profile which precedes it, neither the leading end of one nor the trailing end of the other come into contact with the paint. Obviously this only occurs when the leading end and the trailing end have mating and matching surfaces.

This conventional painting head has several disadvantages however.

First of all, it does not allow to insert one profile at a time into the container, because the afore-said inlet and outlet apertures, when they are not partly obstructed by the profile, cause a sudden increase in the pressure inside the container, up to values near those of atmospheric pressure, with a consequent loss of paint through the apertures, due to the decrease in the suction effect.

Moreover, when the profile has the leading end and the trailing end already worked and shaped, for example to make the frame of a piece of furniture, a painting, a window or door frame or suchlike, and the leading end and/or the trailing end do not have to be painted, the conventional painting head is not able to meet this requirement.

A further disadvantage of the conventional painting head is that, in the event of a sudden interruption in the energy feeding the suction pump, with a consequent increase in the pressure inside the container, the paint contained therein exits uncontrollably from the inlet and outlet apertures, even if there is a profile being worked inside. It is for this reason that below the conventional painting head it is necessary to put a tank or a collection container for the paint, which can contain it to prevent it from falling onto the floor or dirty other machinery nearby.

DE-A-19707157 discloses a device to dust moving flat products having a closed housing with a slotted outlet, a powder-dusting device located inside the housing and a suction device for surplus powder. The powder-dusting device is provided inside a suction chamber of the suction device. The suction chamber is surrounded by a blast chamber and the latter opens out through the slotted outlet of the housing. The powder-dusting device is provided with a nozzle extending especially into the region of the slotted outlet. This outlet and/or the outlet of the suction chamber can be sealed off by a slider, plate, grill or something similar. Also this known device has the above-mentioned disadvantages.

The present Applicant has devised and embodied this invention to overcome these and other shortcomings of conventional painting heads, and also to obtain further advantages, as will be explained hereafter.

SUMMARY OF THE INVENTION

The invention is set forth and characterized in the main claims, while the dependent claims describe other innovative characteristics of the invention.

One purpose of the present invention is to achieve a vacuum painting head with which it is possible to paint even a single object at a time, without any increase in the pressure in the container before and after the object is inserted into the painting head, with a consequent leakage of paint from the container. Objects able to be painted can be, for example: profiles in general, such as frames for paintings, furniture or furnishings, elements for doors and windows, handles for furniture, elements for coffins and suchlike; panels or elements for panels, such as boards, wings for kitchens, furniture, drawers, doors and window frames; various surfaces of panels.

Another purpose of the present invention is to achieve a vacuum painting head which can be selectively commanded to paint only particular parts of the object and not paint others, such as for example the leading end and/or trailing end.

Another purpose of the present invention is to achieve a vacuum painting head wherein the paint is in all cases prevented from leaking from the container when there is a break in supply of energy to the suction means intended to maintain the container in a depression, or vacuum.

In accordance with said purposes, the vacuum painting head according to the present invention comprises a container having a front wall and a rear wall in which an inlet aperture and respectively an outlet aperture are made, the latter having the shape of the object to be painted. Suction means are provided to create inside the container a determinate depression with respect to atmospheric pressure and introduction means are provided to introduce paint, advantageously continuously, inside the container.

In accordance with one characteristic of the present invention, stopper means are inserted in one of said inlet or outlet apertures and are selectively movable to move away from or closer to the other aperture in order to open or close it.

The stopper means advantageously comprise a stopper element inserted into the inlet aperture and connected to actuation means able to move it axially between a first operating position, wherein the stopper element is in proximity with the outlet aperture, and a second operating position, wherein it is distanced therefrom.

The stopper element is shaped so as to internally define a through cavity the transverse section of which is substantially equal to that of the object to be painted.

The inlet aperture has a transverse section in the shape of a regular polygon, advantageously a rectangle, and the stopper element also has a transverse section mating with that of the inlet aperture.

The outlet aperture is bigger by few millimetres than the transverse shape of the object to be painted, to allow the air to enter inside the container, even when the object to be painted is inserted into the outlet aperture.

Elastic means are provided to automatically take the stopper element to a rest position in which it hermetically closes the outlet aperture, thus preventing the paint from leaking out of the container.

With the painting head according to the present invention the following advantages, among others, are obtained: the paint introduced combines with the air which enters the container mainly through the outlet aperture through which the object exits, and is arranged in a constant and controlled turbulent flow, so that, when the stopper element is open, the profile is immersed in the paint and painting is carried out in a uniform manner; it is possible to not paint the leading end and/or trailing end of the object; less power is required for the suction pump which has to create the depression inside the container (from ⅓ to ⅕ of the power required in conventional painting heads); the filter assembly for the paint can be reduced with respect to that of conventional plants.

A further advantage of the painting head according to the present invention is that it can be directed and inclined as desired with respect to a working plane on which the object to be painted is rested.

BRIEF DESCRIPTION OF THE DRAWINGS

These and other characteristics of the present invention will be apparent from the following description of a preferential form of embodiment, given as a non-restrictive example with reference to the attached drawings wherein.

DETAILED DESCRIPTION OF A PREFERENTIAL FORM OF EMBODIMENT OF THE INVENTION

Figure 1:
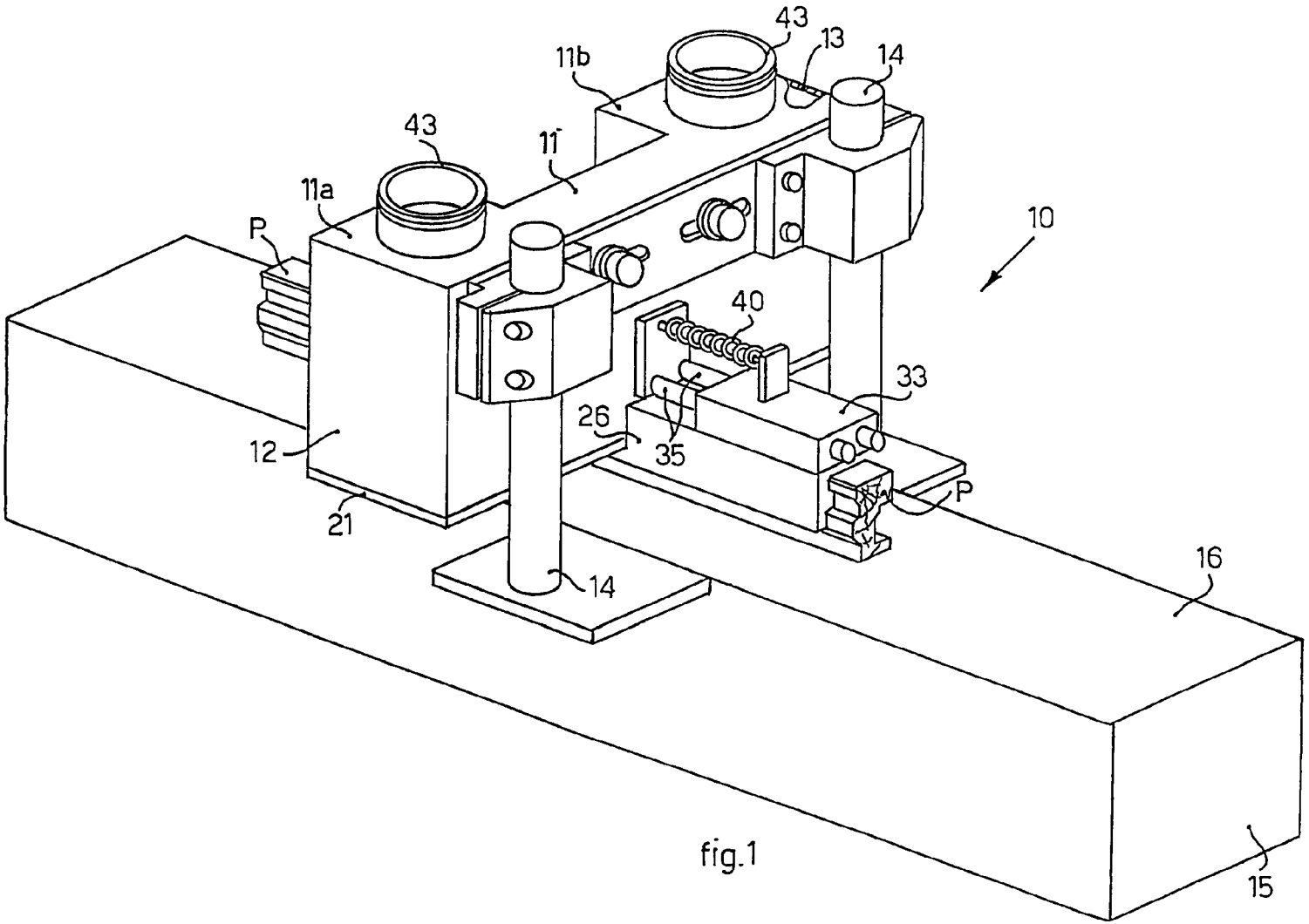
FIG. 1 is a prospective view of a painting head according to the present invention.

With reference to FIG. 1, a painting head 10 according to the present invention, to paint a profile P, comprises a container 11, substantially shaped like a parallelepiped, with two vertical protrusions 11*a* and 11*b* in correspondence with the lateral walls 12 and 13.

The painting head 10 is mounted on two vertical uprights 14 of a base 15, provided with a horizontal work plane 16. The distance between the painting head 10 and the work plane 16 is adjustable according to the profile P to be painted. The painting head 10, moreover, can be directed and inclined as desired, by means of any conventional means, with respect to the work plane 16 on which the profile P to be painted is rested.

The container 11 also comprises a front wall 19 and a rear wall 20 (FIG. 2), parallel to each other, a bottom wall 21 and an upper wall 22.

Figure 4:
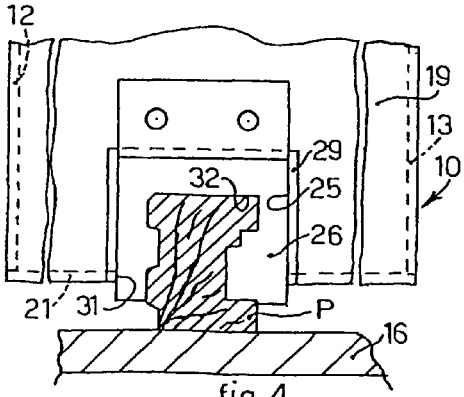
FIG. 4 is a front view, partial and enlarged, of the painting head in FIG. 1.

On the front wall 19 there is an inlet aperture 25 (FIGS. 2 and 4) substantially rectangular in shape, in which a stopper element 26 is permanently inserted, with a substantially rectangular transverse section. The stopper element 26 is able to slide axially in the aperture 25, adhering to the inner surfaces thereof, due to suitable sealing packings 29 interposed.

Figure 5:
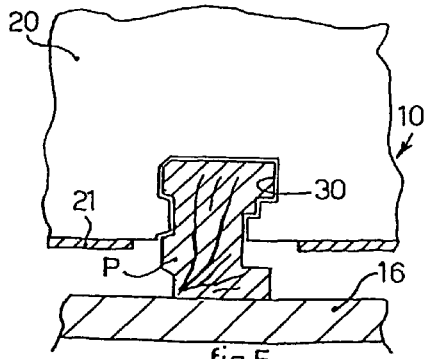
FIG. 5 is a section from V to V of FIG. 3, on a slightly enlarged scale.

On the rear wall 20 there is an outlet aperture 30 (FIG. 5) with the transverse shape of the profile P to be painted, but a few millimetres bigger than it, to allow the air to enter inside the container 11 even when the profile P is inserted into the outlet aperture 30.

On the bottom wall 21 there is a lower aperture 31 (FIGS. 4 and 5), rectangular in shape, with a width corresponding to that of the stopper element 26.

The stopper element 26 is shaped in such a manner as to define internally a through cavity 32 the transverse section of which is equal to that of the profile P to be painted.

The stopper element 26 (FIGS. 2 and 3) is connected outside to a linear actuator 33, which can be either of the fluid-dynamic type, or electric, or magnetic, and which is able to move linearly on guides 35, under the control of position transducers 37 and 39.

Figure 3:
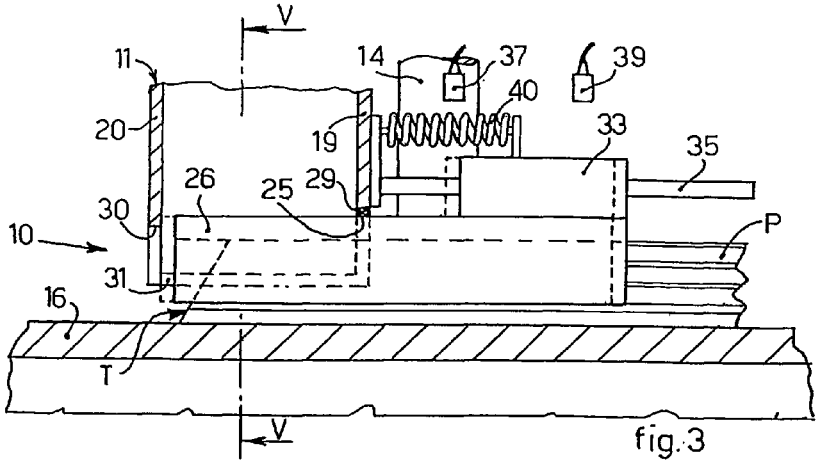
FIG. 3 is an enlarged detail of the painting head in FIG. 2, shown in a second working position.

The linear actuator 33 and the associated stopper element 26 are constantly drawn by a spring 40 towards a rest position, wherein the outlet aperture 30 is closed, shown by a line of dashes in FIG. 3. In this position the painting head 10 is not operative and automatically returns, due to the effect of the spring 40, every time it is not in one of the operating positions which will be explained hereafter.

Inside the container 11, through at least a conduit 42 (FIG. 2), the paint necessary to paint the profile P is able to be introduced, in a continuous cycle.

Through a pair of conduits 43, arranged in correspondence with the protrusions 11*a* and 11*b*, and by means of a suction pump 45 of a conventional type, air is able to be sucked from the container 11 in order to create therein a depression in the range of about 150–250 millibars. The power of the suction pump 45 is indicatively about 2–5 KW (against the 7–11 KW of state of the art pumps) and the quantity of air sucked in is in the range of 800–900 $m^3$ per hour.

Figure 2:
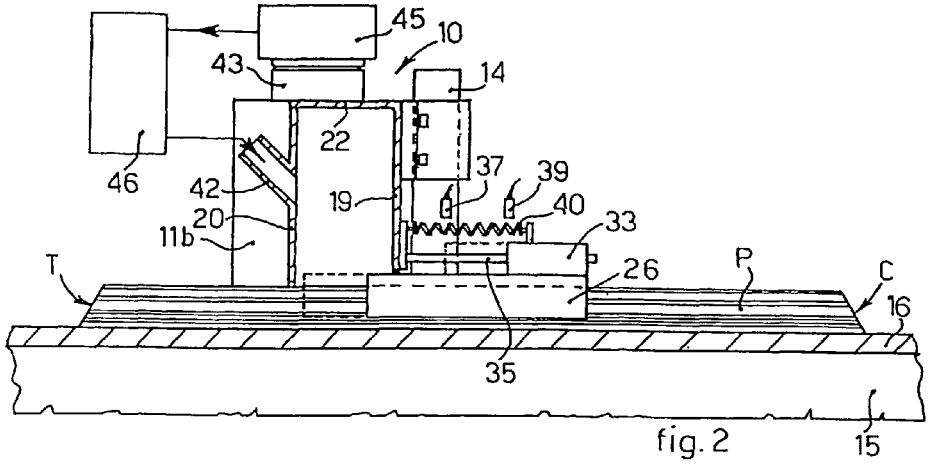
FIG. 2 is a lateral view, partly sectioned, of the painting head in FIG. 1, shown in a first working position.

Between the suction pump 45 and the conduit 42 for the paint, there is a filter assembly 46, also of a conventional type and shown schematically in FIG. 2, which is able to filter the paint sucked in together with the air and to introduce it again into the container 11.

The width of the stopper element 26 is chosen according to the size of the surface of the object to be painted and could also be more than a meter, for example when it is desired to paint in a longitudinal direction, doors, kitchen wings or similar.

The functioning of the painting head 10 as described heretofore is as follows.

In a first stand-by condition, the linear actuator 33 and the associated stopper element 26, against the action of the spring 40, are in the position shown in FIG. 3; the paint is introduced into the container 11 through the conduit 42 and the pump 45 creates the desired depression in the container 11. This position is detected by the transducer 37.

In this condition the outside air enters the container 11 only through the slit, a few millimetres wide, which is created between the apertures 30, 31 and the stopper element 26. The speed at which the air enters is very high, in the range of 30–35 m/s. Due to the effect of this flow of air, the paint does not exit from the apertures 30 and 31. Moreover, inside the container 11 an ascending, vortical and turbulent flow is created, of air and paint, which distributes the paint uniformly in the space defined by the inner walls of the container 11.

When particular surfaces of a profile P are to be painted, for example excluding its leading end T and its trailing end C, a profile P is introduced, manually or mechanically, into the shaped cavity 32 of the stopper element 26 and the profile P is made to advance towards the inside of the container 11, that is, towards the left in FIG. 2, even at high speed, up to 1 m/s.

When the leading end T of the profile P is near to reaching the rear wall 20 of the container 11 (FIG. 3), the linear actuator 33 is energized and immediately moves the stopper element 26 towards the outside of the container 11, stopping it in its position of maximum opening, as shown in FIG. 2, detected by the transducer 39. The stopper element 26 remains in this second operating position until the trailing end C of the profile P is also near to reaching the rear wall 20 of the container 11. Moreover, in this second operating position, the outside air enters the container 11 only through the slit of a few millimetres which is created between the profile P and the outlet aperture 30.

When the trailing end C of the profile P is in proximity with the rear wall 20 of the container 11, the linear actuator 33 is again energized to return the stopper element 26 to the stand-by position, ready to start a new painting cycle.

In the event that it is desired to move the painting head 10 to a rest condition, or non-operative condition, feed is removed from the suction pump 45 and the linear actuator 33. The spring 40 automatically takes the stopper element 26 against the rear wall 20, thus hermetically closing the container 11 and preventing the paint from leaking therefrom. This also happens when feed to the suction pump 45 is suddenly interrupted, in an unexpected and unwanted manner.

It is clear that modifications or additions of parts or steps can be made to the vacuum painting head 10 and the relative painting method as described heretofore, without departing from the field and scope of the present invention. For example, it could be the painting head 10 that moves with respect to the object to be painted, with a controlled feed, while the object remains stationary, as in the case of a painting robot which goes around a table, a piece of furniture or other three-dimensional object, for example an automobile.

It is also clear that, although the present invention has been described with reference to a specific example, a person of skill in the art shall certainly be able to achieve many other forms of equivalent painting heads, all of which shall come within the field and scope of the present invention.

What is claimed is:

1. Vacuum painting head to paint objects, comprising a container having an inlet aperture and an outlet aperture for the object to be painted, wherein said outlet aperture has a transverse section substantially equal to that of said object to be painted, wherein suction means are provided to create inside said container a determinate depression with respect to atmospheric pressure, and wherein introduction means are provided for introducing paint into said container, wherein stopper means are inserted into one of said apertures and are selectively movable to move away from or closer to the other of said apertures to open or close said apertures, wherein said stopper means comprise a stopper element inserted into said inlet aperture and connected to actuation means able to move said stopper element axially between a first operating position, in which said stopper element is in proximity with said outlet aperture, and a second operating position, in which said stopper element is distant from said outlet aperture.

2. Painting head as in claim 1, wherein said stopper element is shaped to define internally a through cavity the transverse section of which is substantially equal to that of said object to be painted.

3. Painting head as in claim 1, wherein said inlet aperture has a transverse section shaped like a regular polygon and said stopper element has a transverse section mating with that of said inlet aperture.

4. Painting head as in claim 3, wherein sealing means are interposed between said stopper element and said inlet aperture.

5. Painting head as in claim 1, wherein said outlet aperture is bigger by few millimetres with respect to said object to be painted, to allow the air to enter inside said container even when said object to be painted is inserted in said outlet aperture.

6. Painting head as in claim 1, wherein said actuation means comprise a linear actuator able to move linearly on guides, under the control of position transducers associated with said first and second operating positions.

7. Painting head as in claim 1, wherein said stopper element is associated with elastic means able to move it towards a rest position in which said stopper element hermetically closes said outlet aperture.

8. Method for the vacuum painting of objects by means of a vacuum painting head comprising a container having an inlet aperture and an outlet aperture for the object to be painted, wherein said outlet aperture has a transverse section substantially equal to that of said object to be painted, wherein suction means are provided to create inside said container a determinate depression with respect to atmospheric pressure, and wherein introduction means are provided for introducing paint into said container, wherein stopper means are inserted into one of said apertures and are selectively movable to move away from or closer to the other of said apertures to open or close said apertures, wherein said stopper means comprise a stopper element inserted into said inlet aperture and connected to actuation means able to move said stopper element axially between a first operating position, in which said stopper element is in proximity with said outlet aperture, and a second operating position, in which said stopper element is distant from said outlet aperture, comprising at least the following steps:

inserting said stopper element into said inlet aperture and selectively axially displacing said stopper element between a first operating position, in which said stopper element is in proximity with said outlet aperture, and a second operating position, in which said stopper element is distant from said outlet aperture.

9. Method as in claim 8, wherein said stopper element is shaped to define internally a through cavity the transverse section of which is substantially equal to that of said profile to be painted.

10. Method as in claim 9, wherein said stopper element is associated with elastic means able to move it towards a rest position in which said stopper element hermetically closes said outlet aperture.

* * * * *